US009583291B2

(12) United States Patent
Kashimura et al.

(10) Patent No.: US 9,583,291 B2
(45) Date of Patent: Feb. 28, 2017

(54) ELECTROMAGNETIC CONTACTOR

(71) Applicants: FUJI ELECTRIC CO., LTD., Kawasaki-shi, Kanagawa (JP); FUJI ELECTRIC FA COMPONENTS & SYSTEMS CO., LTD., Tokyo (JP)

(72) Inventors: Osamu Kashimura, Hino (JP); Masaru Isozaki, Ichihara (JP); Kouetsu Takaya, Kounosu (JP); Yuji Shiba, Kounosu (JP)

(73) Assignees: FUJI ELECTRIC CO., LTD., Kawasaki-shi (JP); FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/847,757

(22) Filed: Sep. 8, 2015

(65) Prior Publication Data

US 2015/0380193 A1 Dec. 31, 2015

Related U.S. Application Data

(63) Continuation of application No. PCT/JP2014/002999, filed on Jun. 5, 2014.

(30) Foreign Application Priority Data

Jul. 5, 2013 (JP) ..... 2013-142057

(51) Int. Cl.
*H01H 50/38* (2006.01)
*H01H 50/54* (2006.01)
(Continued)

(52) U.S. Cl.
CPC ..... *H01H 50/38* (2013.01); *H01H 50/023* (2013.01); *H01H 50/12* (2013.01); *H01H 50/54* (2013.01); *H01H 2205/002* (2013.01)

(58) Field of Classification Search
CPC ..... H01H 50/38; H01H 50/54; H01H 50/023; H01H 50/12; H01H 2205/002
See application file for complete search history.

(56) References Cited

U.S. PATENT DOCUMENTS 3,343,027 A * 9/1967 Frohlich ..... H05H 1/40 219/75
2005/0072591 A1* 4/2005 Hayase ..... H01H 50/14 174/667

(Continued)

FOREIGN PATENT DOCUMENTS

JP 2005-078926 A 3/2005
JP 2012-142195 A 7/2012

(Continued)

OTHER PUBLICATIONS

PCT, "International Search Report for International Application No. PCT/JP2014/002999".

(Continued)

*Primary Examiner* — Mohamad Musleh
(74) *Attorney, Agent, or Firm* — Manabu Kanesaka

(57) ABSTRACT

In an electromagnetic contactor, an arc generated when a movable contact separates from fixed contacts can be easily extinguished. The movable contact is disposed so as to be connectable to and detachable from the pair of fixed contacts disposed to maintain a predetermined interval inside a contact housing case having insulating properties, and an arc extinguishing chamber is formed in a position in which the movable contact and the pair of fixed contacts contact. At least the inner wall surface side of the arc extinguishing chamber contacting an arc is formed of a high thermal conductivity material having thermal conductivity higher than that of a synthetic resin molded material.

13 Claims, 10 Drawing Sheets

(51) Int. Cl.
*H01H 50/12* (2006.01)
*H01H 50/02* (2006.01)

(56) References Cited

U.S. PATENT DOCUMENTS

| | | | | |
|---|---|---|---|---|
| 2012/0313737 | A1* | 12/2012 | Iwamoto ..... | H01H 50/56<br>335/185 |
| 2013/0228552 | A1 | 9/2013 | Kashimura et al. | |
| 2013/0335175 | A1 | 12/2013 | Tachikawa et al. | |

FOREIGN PATENT DOCUMENTS

| | | | |
|---|---|---|---|
| JP | 2012-199095 | A | 10/2012 |
| JP | 2012-243587 | A | 12/2012 |
| JP | 2012-243592 | A | 12/2012 |

OTHER PUBLICATIONS

Japan Patent Office, "Office Action for Japanese Patent Application No. 2015-525015" Jan. 4, 2017.

* cited by examiner

ELECTROMAGNETIC CONTACTOR

RELATED APPLICATIONS

The present application is a Continuation Application of PCT International Application No. PCT/JP2014/002999 filed Jun. 5, 2014, and claiming priority from Japanese Application No. 2013-142057 filed Jul. 5, 2013, the disclosure of which is incorporated herein.

TECHNICAL FIELD

The present invention relates to an electromagnetic contactor including a contact device wherein a movable contact is disposed so as to be connectable to and detachable from fixed contacts and an electromagnet unit that drives the movable contact of the contact device, and in particular, an arc generated when the contacts open and the movable contact separates from the fixed contacts is easily extinguished.

BACKGROUND ART

The electromagnetic contactor described in, for example, PTL 1 is known as an electromagnetic contactor that carries out opening and closing of a current path. In this electromagnetic contactor, a pair of fixed contacts disposed maintaining a predetermined distance and a movable contact disposed so as to be connectable to and detachable from the pair of fixed contacts are disposed inside a contact housing case. Further, an insulating cylinder is disposed on the inner side of the contact housing case so as to enclose the pair of fixed contacts and movable contact. An arc extinguishing permanent magnet that extinguishes an arc generated between the pair of fixed contacts and movable contact is positioned and held in a magnet housing portion in the insulating cylinder, and an arc extinguishing space is formed on the outer sides of the magnet housing portion in the longitudinal direction of the movable contact.

CITATION LIST

Patent Literature

PTL 1: JP-A-2012-243592

SUMMARY OF INVENTION

Technical Problem

However, in PTL 1, the arc extinguishing space is formed in the internal peripheral surface of an insulating cylinder formed of, for example, a resin molded article made of a synthetic resin. Therefore, as the inner wall surface is smoothly finished in the case of a resin molded article, an airflow along the inner wall surface becomes laminar, the amount of heat exchange is small, and the amount of heat exchange is in a saturated state. Also, there is an unresolved problem in that as the thermal conductivity of a resin molded article is small at 0.2 W/mk, the arc cooling effect is low, and the arc electrical field cannot be increased, because of the problem, the arc length for obtaining a predetermined arc voltage increases, and size reduction is difficult.

Therefore, the invention, having been contrived focusing on the unresolved problems of the existing example, has an object of providing an electromagnetic contactor such that arc cooling can be carried out sufficiently, and arc extinguishing carried out easily, without the amount of heat exchange becoming saturated.

Solution to Problem

In order to achieve the heretofore described object, one aspect of an electromagnetic contactor according to the invention is such that a movable contact is disposed so as to be connectable to and detachable from a pair of fixed contacts disposed with a predetermined interval inside a contact housing case having insulating properties, and an arc extinguishing chamber is formed in positions in which the movable contact and the pair of fixed contacts contact. At least the inner wall surface side of the arc extinguishing chamber that contacts an arc is formed of a high thermal conductivity material having thermal conductivity higher than that of a synthetic resin molded material.

Advantageous Effects of Invention

According to the invention, at least the inner wall surface side of the arc extinguishing chamber that contacts an arc is formed of a high thermal conductivity material having thermal conductivity higher than that of a synthetic resin molded material. Because of this, the thermal transmission of the arc contact surface can be increased, and arc cooling can thus be sufficiently carried out. As a result of this, the arc electrical field increases, and the arc length for obtaining a predetermined arc voltage can thus be reduced. Thus, the size of the arc extinguishing space for extending the arc can be reduced, and a reduction in size and reduction in weight are thus possible.

Also, when the arc length is reduced, the time until interruption is completed (the time for which the arc is maintained) decreases, wearing down of the contacts of the fixed contacts and movable contact can be restricted, and an increase in the lifespan as a contactor can thus be achieved.

DESCRIPTION OF EMBODIMENTS

Hereafter, a description will be given, based on the drawings, of embodiments of the invention.

Figure 1:
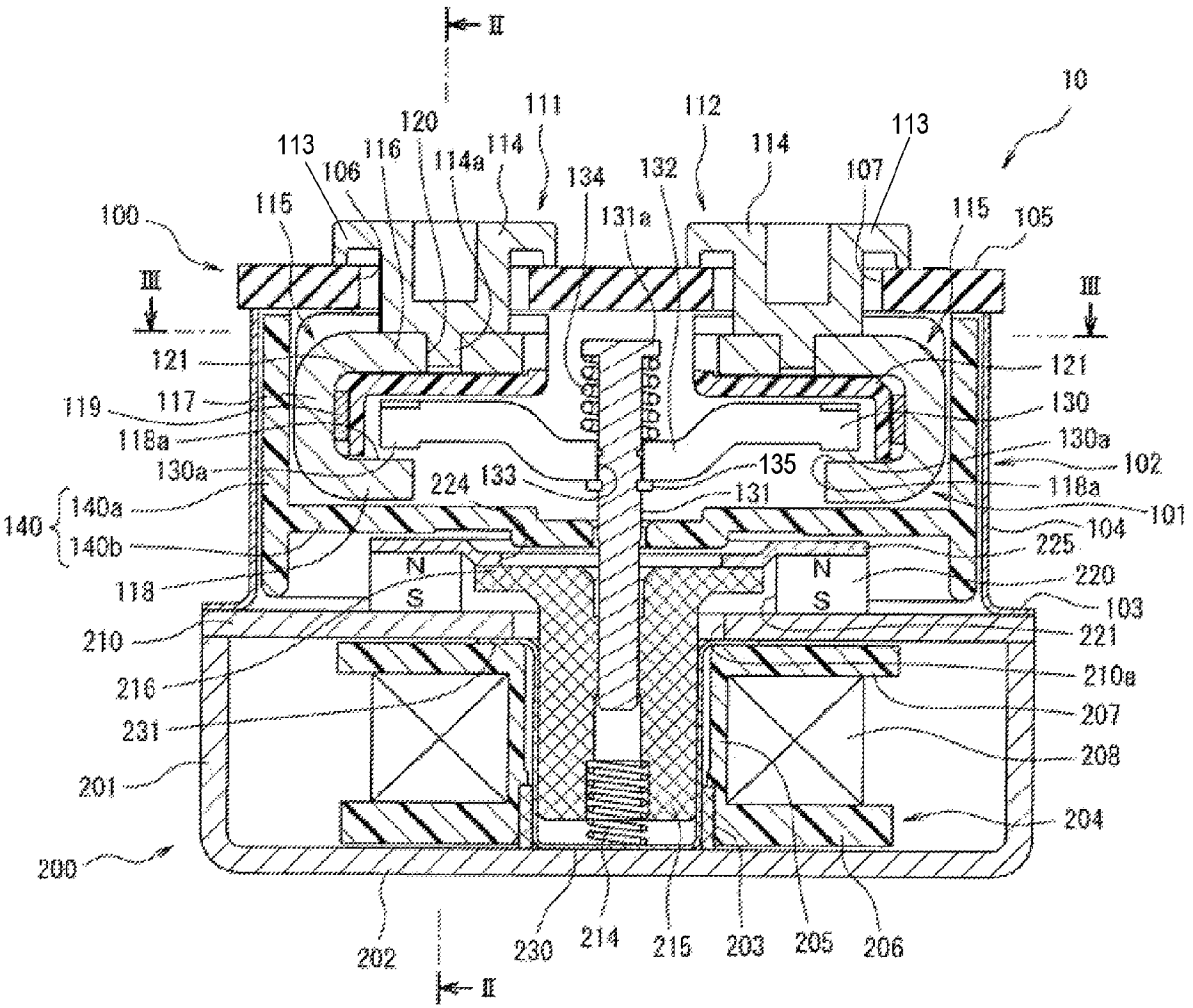
FIG. 1 is a sectional view showing an embodiment of an electromagnetic contactor according to the invention.
Figure 2:
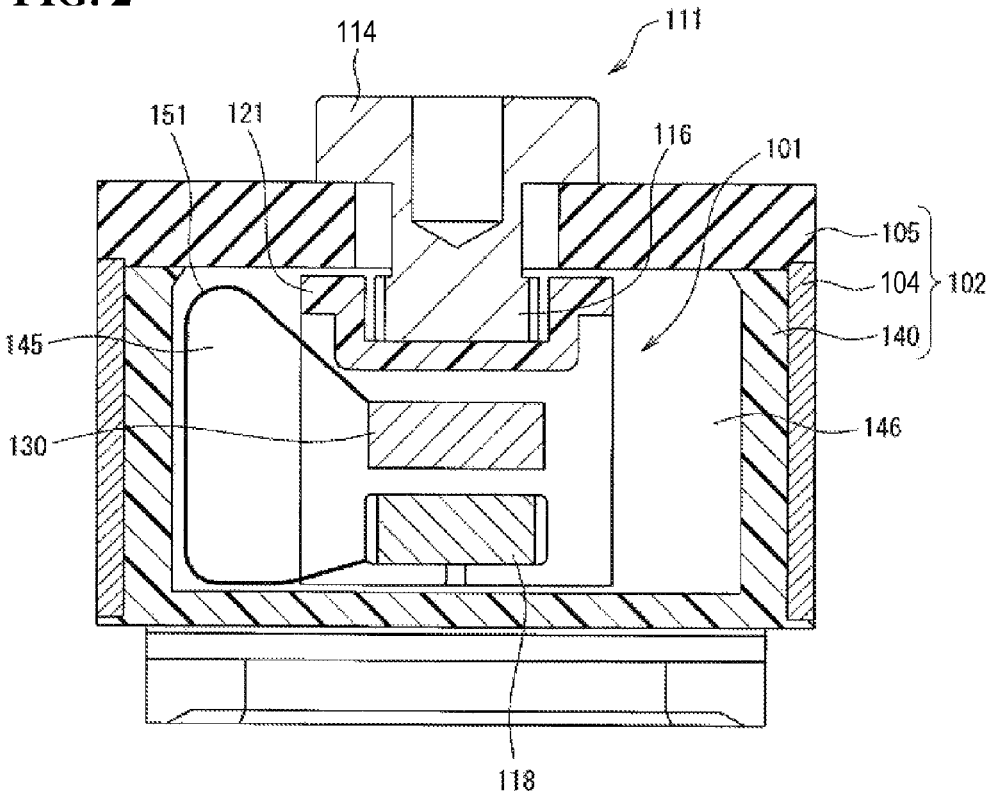
FIG. 2 is a sectional view showing an enlargement of one portion of a contact device along a line II-II of FIG. 1.
Figure 3:
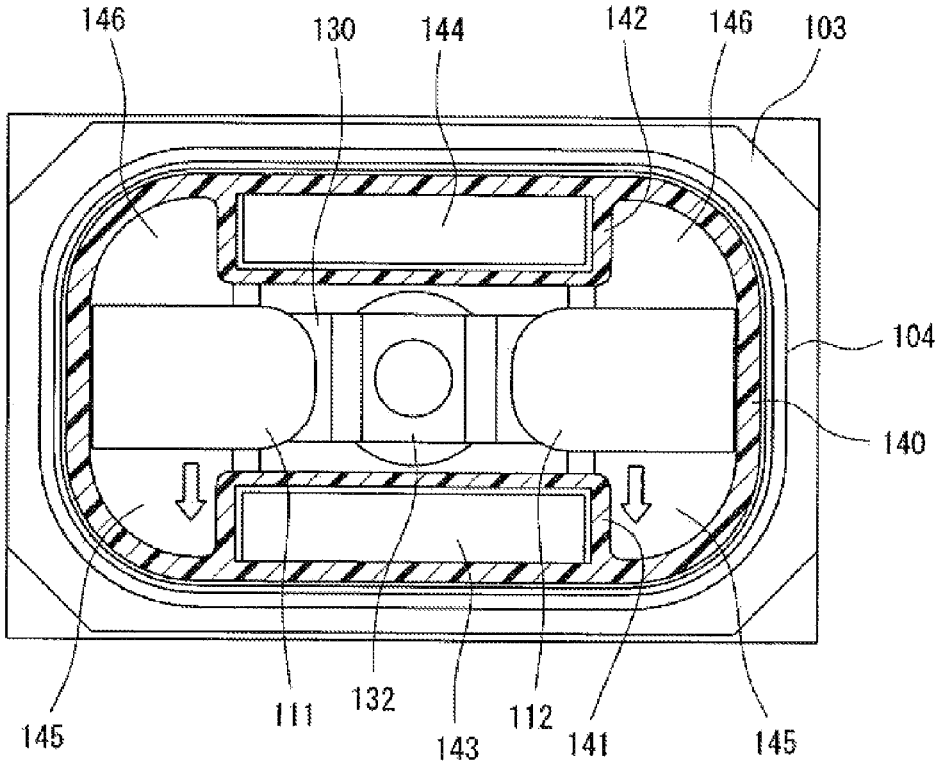
FIG. 3 is a sectional view along a line of FIG. 1.

FIG. 1 is a sectional view showing one example of an electromagnetic contactor according to the invention, while FIG. 2 is a sectional view of a contact device along a line II-II of FIG. 1. FIG. 3 is a sectional view along a line III-III of FIG. 1.

In FIG. 1 to FIG. 3, numeral 10 is an electromagnetic contactor, and the electromagnetic contactor 10 includes a contact device 100 in which is disposed a contact mechanism, and an electromagnet unit 200 that drives the contact device 100.

The contact device 100 has a contact housing case 102 that houses a contact mechanism 101, as is clear from FIG. 1 to FIG. 3. The contact housing case 102 includes a metal tubular body 104 having on a metal lower end portion a flange portion 103 protruding outward, a fixed contact support insulating substrate 105 that closes the upper end of the metal tubular body 104, and an insulating cylinder 140 disposed on the inner peripheral side of the metal tubular body 104.

The metal tubular body 104 is formed of, for example, stainless steel, and the flange portion 103 thereof is seal joined and fixed to an upper magnetic yoke 210 of the electromagnet unit 200, to be described hereafter.

Also, the fixed contact support insulating substrate 105 is a plate form ceramic insulating substrate, and through holes 106 and 107 in which is inserted a pair of fixed contacts 111 and 112, to be described hereafter, are formed maintaining a predetermined interval in a central portion of the fixed contact support insulating substrate 105.

The contact mechanism 101, as shown in FIG. 1, includes the pair of fixed contacts 111 and 112 inserted into and fixed in the through holes 106 and 107 of the fixed contact support insulating substrate 105 of the contact housing case 102. Each of the fixed contacts 111 and 112 includes a support conductor portion 114, having on an upper end a flange portion 113 protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed, in a C-shape, of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112.

Herein, the support conductor portion 114 and C-shaped portion 115 are fixed by, for example, brazing in a condition in which a pin 114*a* protruding on the lower end surface of the support conductor portion 114 is inserted into a through hole 120 formed in the upper plate portion 116 of the C-shaped portion 115. The fixing of the support conductor portion 114 and C-shaped portion 115 is not limited to brazing, and the pin 114*a* is fitted into the through hole 120, or an external thread is formed on the pin 114*a* and an internal thread is formed in the through hole 120, and the two are screwed together.

Further, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115.

By mounting the insulating cover 121 on the C-shaped portion 115 of the fixed contacts 111 and 112 in this way, only the upper surface side of the lower plate portion 118 is exposed on the inner peripheral surface of the C-shaped portion 115 to be a contact portion 118*a*.

Further, a movable contact 130 is disposed in such a way that the two end portions thereof are disposed one each in the C-shaped portions 115 of the fixed contacts 111 and 112. The movable contact 130 is supported by a connecting shaft 131 fixed to a movable plunger 215 of the electromagnet unit 200, to be described hereafter. In the movable contact 130, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130. Further, the upper end of the contact spring 134 contacts the flange portion 131*a*, and the movable contact 130 is positioned using, for example, a C-ring 135, so as to obtain a predetermined biasing force from the contact spring 134.

The movable contact 130, in a released condition, takes a state wherein the contact portions at both ends and the contact portions 118*a* of the lower plate portions 118 of the C-shaped portions 115 of the fixed contacts 111 and 112 are separated from each other to maintain a predetermined interval. Also, the movable contact 130 is set so that, in an engaged position, the contact portions at both end contacts the contact portions 118*a* of the lower plate portions 118 of the C-shaped portions 115 of the fixed contacts 111 and 112 at a predetermined contact pressure from the contact spring 134.

Furthermore, the insulating cylinder 140 (140*a* and 140*b*) forming the contact housing case 102 is molded from a ceramic high thermal conductivity material, such as alumina ceramic (thermal conductivity 30 W/mK), aluminum nitride (thermal conductivity 180 W/mK), or boron nitride (thermal conductivity 63 W/mK), whose thermal conductivity is higher than the thermal conductivity of 0.2 W/mK of a synthetic resin molded material formed of a thermosetting resin such as an unsaturated polyester resin or phenol resin, and which has insulating properties. It is preferable that the thermal conductivity of the high thermal conductivity material is higher than the thermal conductivity of 20 W/mK at high temperature (4,000° C., 1 atm) of hydrogen, which is a gas encapsulated inside the contact housing case 102, as will be described hereafter.

Magnet housing pockets 141 and 142 are formed protruding inward in positions on the insulating cylinder 140 facing the side surfaces in a central portion in the longitudinal direction of the movable contact 130. Arc extinguishing permanent magnets 143 and 144 are inserted into and fixed in the magnet housing pockets 141 and 142.

The arc extinguishing permanent magnets 143 and 144 are magnetized in a thickness direction so that mutually opposing faces thereof are homopolar, for example, N-poles. Further, arc extinguishing chambers 145 and 146 are formed on the outer sides in a left-right direction of the magnet housing pockets 141 and 142 respectively, and in contact positions of the contact portions 118*a* of the pair of fixed contacts 111 and 112 and the contact portions 130*a* of the movable contact 130.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed as a plunger drive portion on the outer side of the cylindrical auxiliary yoke 203.

The spool 204 includes a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted to be wound in a housing space formed of the central cylinder portion 205, lower flange portion 206, and upper flange portion 207.

Also, an upper magnetic yoke 210 is fixed between upper ends forming an opened end of the magnetic yoke 201. A through hole 210*a* opposing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, an annular permanent magnet 220 formed in a ring-form is fixed to the upper surface of the upper magnetic yoke 210 so as to enclose the peripheral flange portion 216 of the movable plunger 215. The annular permanent magnet 220 is formed with a rectangular external form, and has in a central portion thereof a through hole 221 enclosing the peripheral flange portion 216. The annular permanent magnet 220 is magnetized in an up-down direction, that is, a thickness direction, so that the upper end side is, for example, an N-pole while the lower end side is an S-pole. Taking the form of the through hole 221 of the annular permanent magnet 220 to be a form tailored to the form of the peripheral flange portion 216, the form of the outer peripheral surface can be any form, such as circular or rectangular. In the same way, the external form of the annular permanent magnet 220 is not limited to a rectangular form, and can also be any form, such as circular or hexagonal.

Further, an auxiliary yoke 225 of the same external form as the annular permanent magnet 220, and having a central aperture 224, is fixed to the upper end surface of the annular permanent magnet 220.

Also, the movable plunger 215, as shown in FIG. 1, is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 communicate via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described first embodiment.

Herein, it is assumed that the fixed contact 111 is connected to, for example, a power supply source that supplies a large current, while the fixed contact 112 is connected to a load.

In this state, the exciting coil 208 in the electromagnet unit 200 is in a non-excited state, and there exists a released state wherein no exciting force causing the movable plunger 215 to descend is generated in the electromagnet unit 200. In this released state, the movable plunger 215 is urged in an upward direction away from the upper magnetic yoke 210 by the return spring 214.

Simultaneously with this, a suctioning force created by the magnetic force of the annular permanent magnet 220 acts on the auxiliary yoke 225, and the peripheral flange portion 216 of the movable plunger 215 is suctioned. Therefore, the upper surface of the peripheral flange portion 216 of the movable plunger 215 contacts the lower surface of a stepped plate portion of the auxiliary yoke 225.

Therefore, the contact portions 130*a* of the movable contact 130 of the contact mechanism 101 connected to the movable plunger 215 via the connecting shaft 131 are separated by a predetermined distance upward from the contact portions 118*a* of the fixed contacts 111 and 112. Therefore, the current path between the fixed contacts 111 and 112 is in an interrupted state, and the contact mechanism 101 is in a condition wherein the contacts are opened.

In this way, as the biasing force of the return spring 214 and the suctioning force of the annular permanent magnet 220 both act on the movable plunger 215 in the released state, there is no unintentional downward movement of the movable plunger 215 due to external vibration, shock, or the like, and it is thus possible to reliably prevent malfunction.

Upon excitation of the exciting coil 208 of the electromagnet unit 200 in the released state, an exciting force is generated in the electromagnet unit 200, and the movable plunger 215 is pressed downward against the biasing force of the return spring 214 and the suctioning force of the annular permanent magnet 220.

By the movable plunger 215 descending in this way, the movable contact 130 connected to the movable plunger 215 via the connecting shaft 131 also descends, and the contact portions 130*a* contacts the contact portions 118*a* of the fixed contacts 111 and 112 with the contact pressure of the contact spring 134.

Therefore, there exists a closed contact state wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction such as to cause the contact portions of the movable contact 130 to open.

However, as the fixed contacts 111 and 112 are formed such that the C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions.

Therefore, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Therefore, owing to the Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening.

Therefore, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

When interrupting the supply of current to the load in the closed contact condition of the contact mechanism 101, the excitation of the exciting coil 208 of the electromagnet unit 200 is stopped.

By so doing, the exciting force causing the movable plunger 215 to move downward in the electromagnet unit 200 stops, and because of this, the movable plunger 215 is raised by the biasing force of the return spring 214, and the suctioning force of the annular permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 contacts the fixed contacts 111 and 112 for as long as contact pressure is applied by the contact spring 134. Subsequently, there starts an opened contact state, wherein the movable contact 130 moves upward away from the fixed contacts 111 and 112 at the point the contact pressure of the contact spring 134 stops.

Upon starting the opened contact state, an arc is generated between the contact portions 118*a* of the fixed contacts 111 and 112 and the contact portions 130*a* of the movable contact 130, and the state in which current is conducted continues owing to the arc.

At this time, as the insulating cover 121 is mounted to cover the upper plate portion 116 and intermediate plate portion 117 of the C-shaped portions 115 of the fixed contacts 111 and 112, it is possible to cause the arc to be generated only between the contact portions 118*a* of the fixed contacts 111 and 112 and the contact portions 130*a* of the movable contact 130. Therefore, it is possible to stabilize the arc generation state, and possible to extinguish the arc by extending the arc to the arc extinguishing chamber 145 or 146, and thus possible to improve arc extinguishing performance.

Also, the upper plate portion 116 and intermediate plate portion 117 of the C-shaped portion 115 are covered by the insulating cover 121. Therefore, it is possible to maintain insulating distance with the insulating cover 121 between the two end portions of the movable contact 130 and the upper plate portion 116 and intermediate plate portion 117 of the C-shaped portion 115, and thus possible to reduce the height in the direction in which the movable contact 130 can move. Consequently, it is possible to reduce the size of the contact device 100.

Furthermore, as the inner surface of the intermediate plate portion 117 of the fixed contacts 111 and 112 is covered by the magnetic plate 119, a magnetic field generated by current flowing through the intermediate plate portion 117 is shielded by the magnetic plate 119. Therefore, there is no interference between a magnetic field caused by the arc generated between the contact portions 118*a* of the fixed contacts 111 and 112 and the contact portions 130*a* of the movable contact 130 and the magnetic field generated by the current flowing through the intermediate plate portion 117, and it is thus possible to prevent the arc being affected by the magnetic field generated by the current flowing through the intermediate plate portion 117.

Figure 4A:
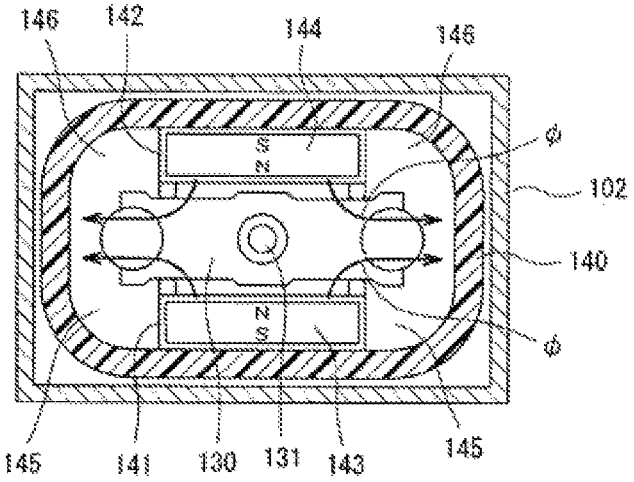
FIGS. 4(*a*) to 4(*c*) are illustrations illustrating an arc generation state.
Figure 4B:
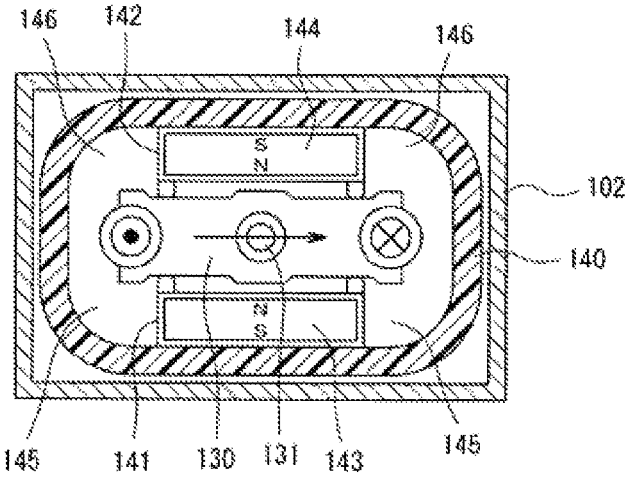
Figure 4C:
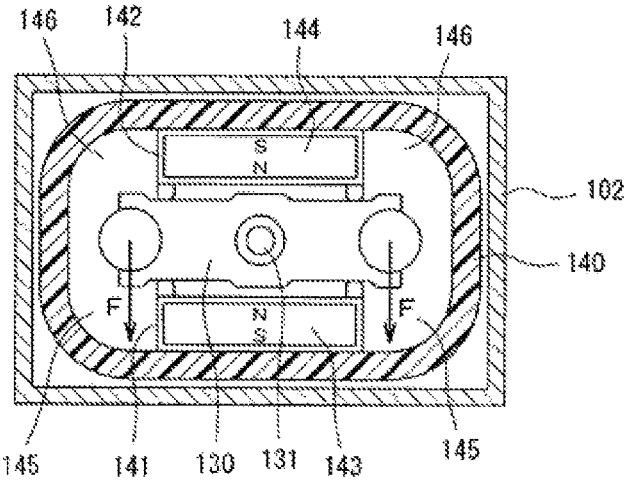

Meanwhile, as the opposing magnetic pole faces of the arc extinguishing permanent magnets 143 and 144 are N-poles, and the outer sides thereof are S-poles, magnetic flux emanating from the N-poles, seen in plan view as shown in FIG. 4(*a*), crosses an arc generation portion of a portion in which the contact portion 118*a* of the fixed contact 111 and the contact portion 130*a* of the movable contact 130 are opposed, from the inner side to the outer side in the longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing permanent magnets 143 and 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Therefore, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 4(*b*). Therefore, in accordance with Fleming's left-hand rule, a large Lorentz force F acts toward the arc extinguishing chamber 145 side, perpendicular to the longitudinal direction of the movable contact 130 and perpendicular to the switching direction of the contact portion 118*a* of the fixed contact 111 and the movable contact 130, as shown in FIG. 4(*c*).

Owing to the Lorentz force F, an arc 151 generated between the contact portion 118*a* of the fixed contact 111 and the contact portion 130*a* of the movable contact 130 is greatly extended from the side surface of the contact portion 118*a* of the fixed contact 111 to the inner wall of the arc extinguishing chamber 145, following the inner wall to reach the upper surface side of the movable contact 130, as shown in FIG. 2.

The insulating cylinder 140 forming the inner wall surface of the arc extinguishing chamber 145 is formed of a high thermal conductivity material, such as alumina ceramic (thermal conductivity 30 W/mK), aluminum nitride (thermal conductivity 180 W/mK), or boron nitride (thermal conductivity 63 W/mK), whose conductivity is higher than the thermal conductivity (0.2 W/mK) of a normally used synthetic resin molded material formed of a thermosetting resin such as an unsaturated polyester resin or phenol resin, and higher than the thermal conductivity (20 W/mK) at high temperature (4,000° C., 1 atm) of the hydrogen encapsulated inside the contact housing case 102.

When the arc comes to follow the inner wall surface of the arc extinguishing chamber 145 in this way, the thermal conductivity of the inner wall surface of the arc extinguishing chamber 145, and the interior thereof, increases, and it is thus possible for the heat of the arc 151 to be efficiently transferred inside the wall of the arc extinguishing chamber 145. Consequently, cooling of the arc 151 can be sufficiently carried out.

As a result of this, the arc electrical field can be increased, and the arc length for obtaining a predetermined arc voltage can thus be reduced. Consequently, the size of the arc extinguishing space for extending the arc 151 can be reduced, and a reduction in size and reduction in weight of the contact device 100 can thus be achieved.

Also, when the arc length is reduced, the time until interruption is completed (the time for which the arc is maintained) decreases, wearing of the contacts of the fixed contacts and movable contact can be restricted, and an increase in the lifespan as a contactor can thus be achieved.

Meanwhile, the current I flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 4(*b*). Therefore, in accordance with Fleming's left-hand rule, a large Lorentz force F acts toward the arc extinguishing space 145 side, perpendicular to the longitudinal direction of the movable contact 130 and perpendicular to the switching direction of the contact portion 118*a* of the fixed contact 112 and the movable contact 130.

Owing to the Lorentz force F, the arc 151 generated between the contact portion 118*a* of the fixed contact 112 and the movable contact 130 is greatly extended so as to pass from the upper surface side of the movable contact 130 through the inside of the arc extinguishing chamber 145. Here too, the insulating cylinder 140 is formed of a high thermal conductivity material, such as alumina ceramic (thermal conductivity 30 W/mK), aluminum nitride (thermal conductivity 180 W/mK), or boron nitride (thermal conductivity 63 W/mK), whose conductivity is higher than the thermal conductivity (0.2 W/mK) of a normally used synthetic resin molded material formed of a thermosetting resin such as an unsaturated polyester resin or phenol resin, and higher than the thermal conductivity (20 W/mK) at high temperature (4,000° C., 1 atm) of the hydrogen encapsulated inside the contact housing case 102. Therefore, in the same way as between the contact portion 118*a* of the fixed contact 111 and the movable contact 130, the thermal conductivity is increased, the arc 151 is sufficiently cooled, and the arc 151 can be reliably interrupted.

Meanwhile, in the engaged condition of the electromagnetic contactor 10, when adopting a released state in a state wherein a regenerative current flows from the load side to the direct current power source side, the direction of current in FIG. 4(*b*) is reversed, meaning that the Lorentz force F acts on the arc extinguishing chamber 146 side, and excepting that the arc is extended to the arc extinguishing chamber 146 side, the same arc extinguishing function is fulfilled.

At this time, as the arc extinguishing permanent magnets 143 and 144 are disposed in the magnet housing pockets 141 and 142 formed in the insulating cylinder 140, the arc 151 does not contact the arc extinguishing permanent magnets 143 and 144. Therefore, it is possible to stably maintain the magnetic characteristics of the arc extinguishing permanent magnets 143 and 144, and thus possible to stabilize interruption performance.

Also, as it is possible to cover and insulate the inner peripheral surface of the metal tubular body 104 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, and the function of protecting the arc extinguishing permanent magnets 143 and 144 from the arc with the one insulating cylinder 140, it is possible to reduce manufacturing cost.

Any high thermal conductivity material can be applied as the material of the insulating cylinder 140, provided that the material has insulating properties, and has thermal conductivity higher than the thermal conductivity (0.2 W/mK) of a normally used synthetic resin molded material formed of a thermosetting resin such as an unsaturated polyester resin or phenol resin.

Figure 5:
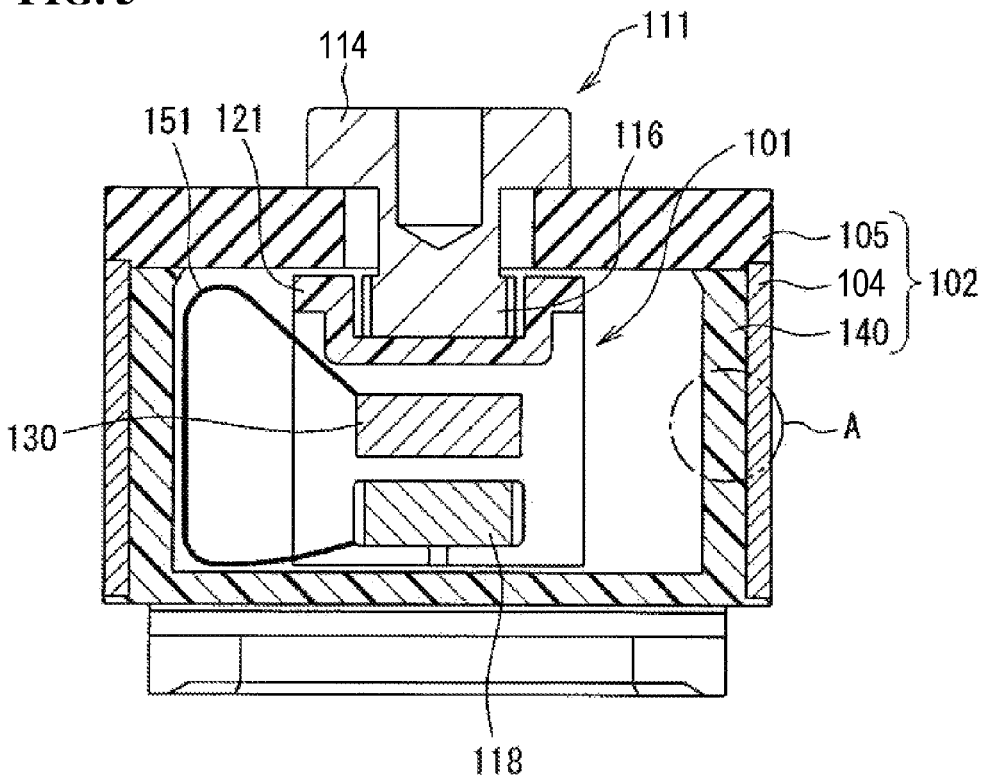
FIG. 5 is a sectional view the same as FIG. 2 showing a second embodiment of the invention.

Next, referring to FIG. 5 and FIG. 6, a description will be given of a second embodiment of the invention.

In the second embodiment, the configuration of the insulating cylinder is changed.

Figure 6:
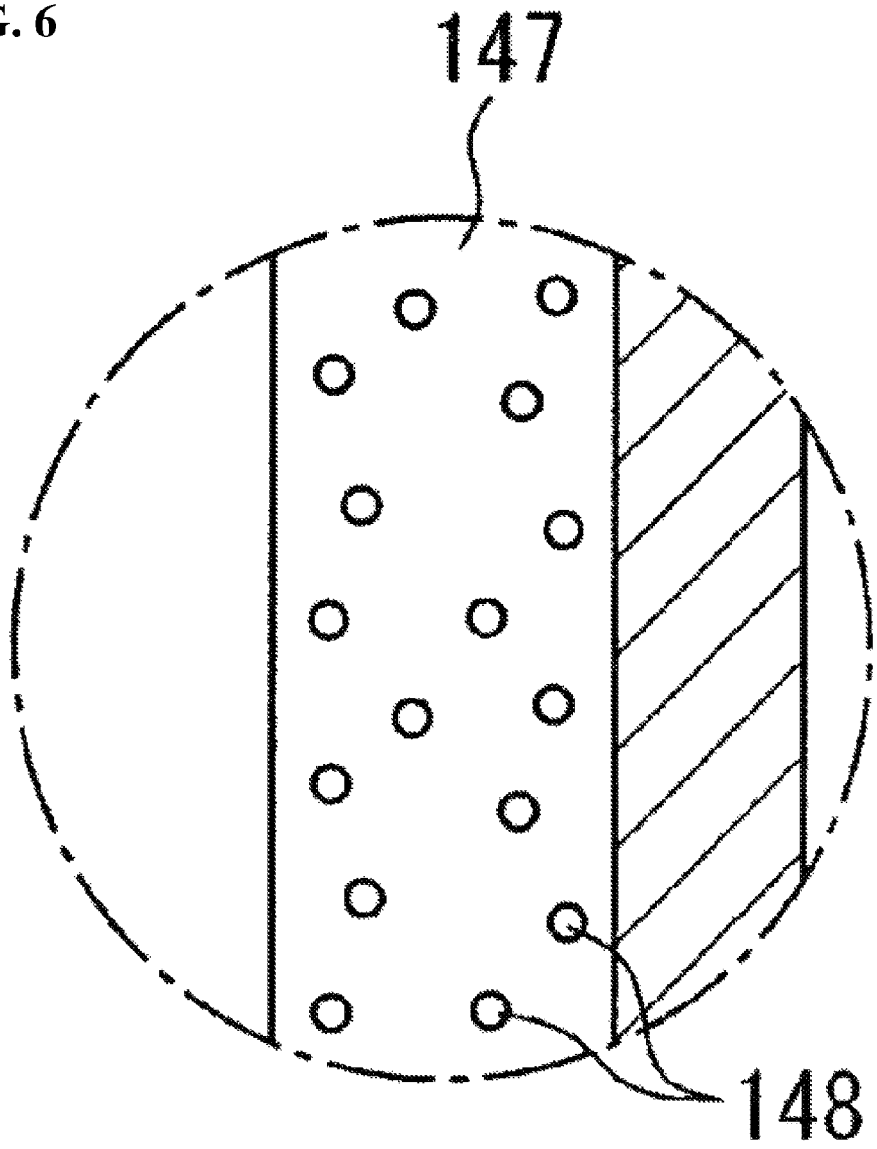
FIG. 6 is an enlarged sectional view of a portion A of FIG. 5.

That is, in the second embodiment, the insulating cylinder 140 is made of a synthetic resin molded material wherein a thermosetting resin 147 such as an unsaturated polyester resin or phenol resin is mixed with a thermally conductive filler 148 formed of a powder, or the like, with high thermal conductivity, such as alumina ceramic, aluminum nitride, boron nitride, iron, aluminum, or copper, whose thermal conductivity is higher than that of the thermosetting resin, as shown in FIG. 6, thereby increasing thermal conductivity while maintaining the insulating performance of the molded resin material. Configurations other than this are the same as in the first embodiment.

According to the second embodiment, the thermal conductivity of the synthetic resin molded material itself is increased by mixing the thermosetting resin 147 with the thermally conductive filler 148. Because of this, the same operational advantages as in the first embodiment can be obtained. Moreover, as the high thermal conductivity material, the thermosetting resin 147 is simply mixed with the thermally conductive filler 148, manufacturing cost can be considerably restricted in comparison with the ceramic material of the first embodiment.

Herein, it is not limited to a powder, or the like, with high thermal conductivity, such as alumina ceramic, aluminum nitride, boron nitride, iron, aluminum, or copper, whose thermal conductivity is higher than that of the thermosetting resin, any high thermal conductivity material whose thermal conductivity is higher than that of the thermosetting resin can be applied as the thermally conductive filler 148, and the form is not limited to powder, any form, such as a short fiber, is possible.

Next, with reference to FIG. 7, a description will be given of a third embodiment of the invention.

In the third embodiment, a high thermal conductivity material is insert molded in the surface of the insulating cylinder 140.

Figure 7:
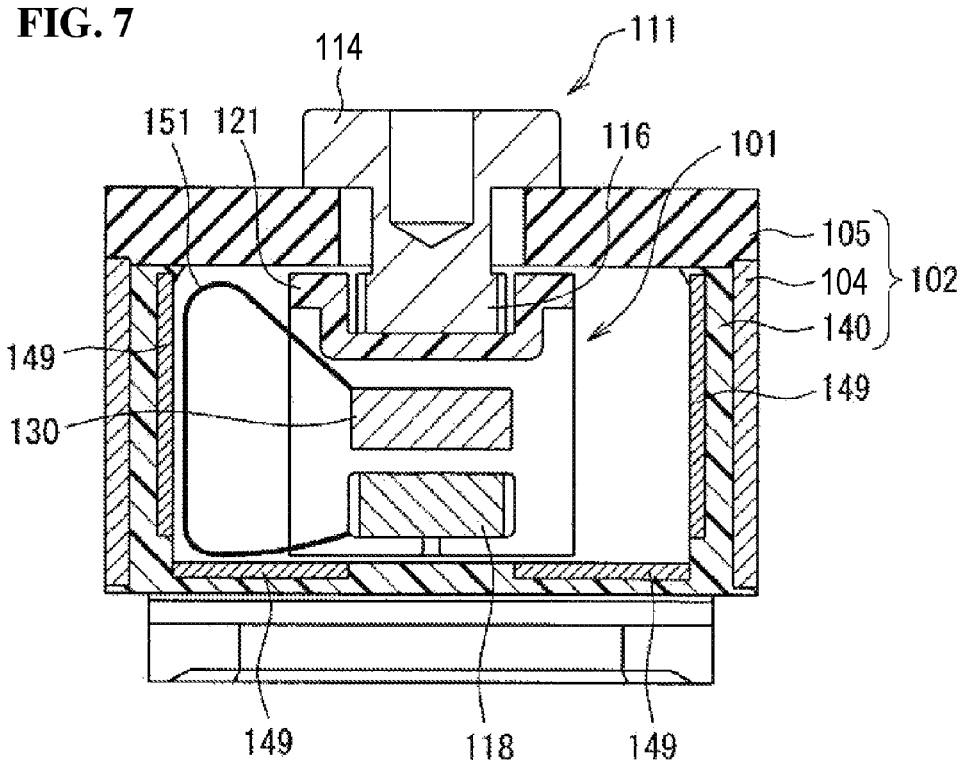
FIG. 7 is a sectional view the same as FIG. 2 showing a third embodiment of the invention.

That is, in the third embodiment, a high thermal conductivity plate 149 acting as a high thermal conductivity material made of a metal such as copper or CuW, whose thermal conductivity is higher than that of the thermosetting resin material, is insert molded so as to form an inner wall surface side when molding the insulating cylinder 140 of a thermosetting resin material formed of an unsaturated polyester resin or phenol resin, as shown in FIG. 7. Configurations other than this are the same as in the first embodiment.

According to the third embodiment, the metal high thermal conductivity plate 149 acting as a high thermal conductivity material is insert molded in the inner wall surface of the insulating cylinder 140. Because of this, the heat of the arc 151 can be efficiently transferred inside the wall of the arc extinguishing chamber 145 when the arc 151 generated when the contacts open is extended to reach the vicinity of the inner wall surface of the insulating cylinder 140. Consequently, cooling of the arc 151 can be sufficiently carried out.

As a result of this, the arc electrical field can be increased, and the arc length for obtaining a predetermined arc voltage can thus be reduced. Consequently, the size of the arc extinguishing space for extending the arc 151 can be reduced, and a reduction in size and reduction in weight of the contact device 100 can thus be achieved.

In the third embodiment, a description has been given of a case wherein the high thermal conductivity plate 149 is insert molded, but it is not limited to this, and any metal material or ceramic having thermal conductivity higher than that of the thermosetting resin material configuring the insulating cylinder may be applied as a coating to the inner peripheral surface of the insulating cylinder 140.

Also, the metal high thermal conductivity plate 149 with thermal conductivity higher than that of the thermosetting resin material may be coated with an insulating material, and insert molded in, attached to, or fixed by screwing to the inner wall of the insulating cylinder 140.

Next, with reference to FIG. 8, a description will be given of a fourth embodiment of the invention.

In the fourth embodiment, a metal thermally conductive material covering the inner peripheral surface of the insulating cylinder 140 is mounted instead of a high thermal conductivity plate being insert molded.

Figure 8:
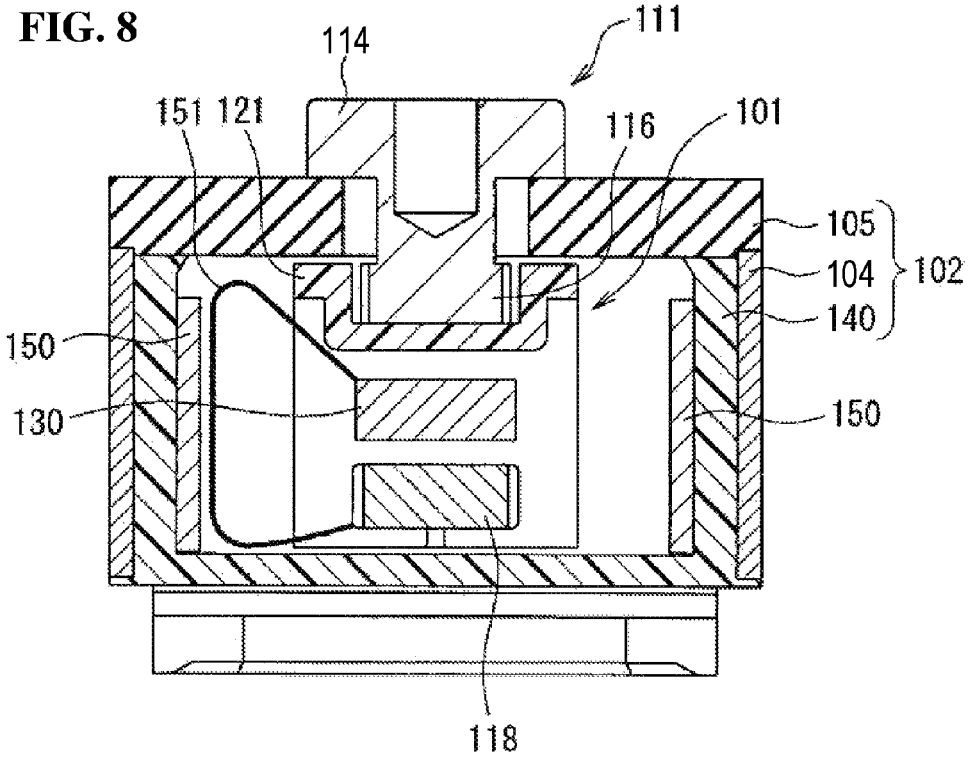
FIG. 8 is a sectional view the same as FIG. 2 showing a fourth embodiment of the invention.

That is, in the fourth embodiment, a high thermal conductivity cylinder 150 formed of a high thermal conductivity material such as copper or CuW, whose thermal conductivity is higher than that of the thermosetting resin material, is disposed in close contact with the inner peripheral surface of the insulating cylinder 140 formed of a thermosetting resin such as an unsaturated polyester resin or phenol resin, as shown in FIG. 8. A mechanical joining such as attachment or screwing is employed as the method of disposing the high thermal conductivity cylinder 150. Configurations other than this are the same as in the first embodiment.

According to the fourth embodiment, the high thermal conductivity cylinder 150 is disposed in close contact with the inner peripheral surface of the insulating cylinder 140. Because of this, the same operational advantages as in the third embodiment can be obtained.

Herein, any high thermal conductivity material can be applied as the material of the high thermal conductivity cylinder 150, provided that the thermal conductivity thereof is higher than that of the thermosetting resin forming the insulating cylinder 140.

In the first to fourth embodiments, a description has been given of a case wherein the thermal conductivity of the insulating cylinder is increased or a high thermal conductivity material is disposed on the inner wall surface contacting with the arc 151, but it is not limited to this, and a high thermal conductivity material may be disposed on the inner wall surface of the insulating cylinder in addition to the thermal conductivity of the insulating cylinder being increased.

Also, in the third and fourth embodiments, as it is sufficient that the high thermal conductivity material is disposed only on at least the inner wall surface with which the arc 151 generated when the contacts open, there is no need for the high thermal conductivity material to be disposed over the whole of the inner wall surface of the insulating cylinder 140.

Also, in the first to fourth embodiments, a description has been given of a case wherein the contact housing case 102 of the contact device 100 is formed of the metal tubular body 104, fixed contact support insulating substrate 105, and insulating cylinder 140, but it is not limited to this, and the fixed contact support insulating substrate 105 can be omitted, and the contact housing case 102 formed of the metal tubular body 104, a tub-form insulating cylinder in which the lower end is opened, and an insulating bottom plate that covers the lower surface of the tub-form insulating cylinder, may be used.

Also, the contact mechanism 101 is not being limited to the configuration of the heretofore described embodiments either, and a contact mechanism of an arbitrary configuration can be applied.

Figure 9A:
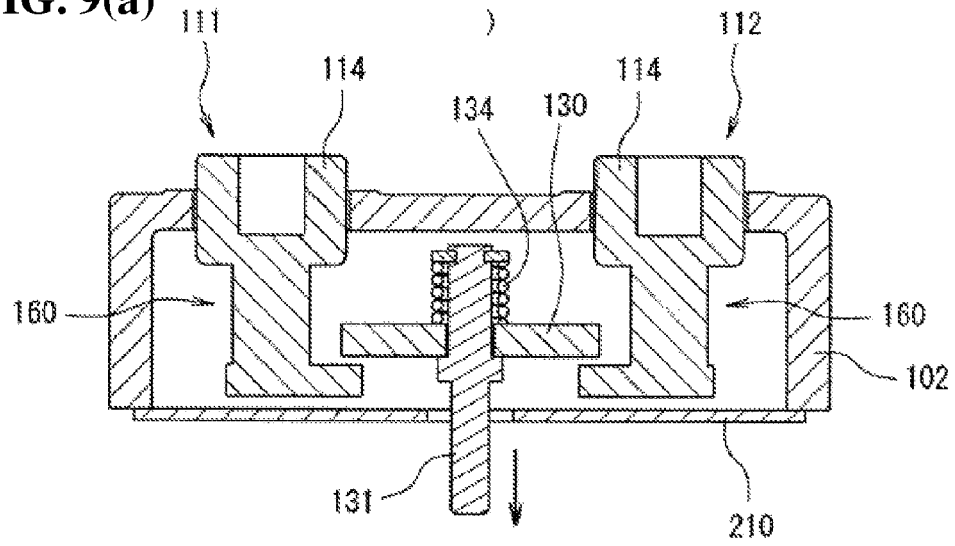
FIGS. 9(*a*) and 8 (*b*) are diagrams showing a modification example of a contact device applicable to the invention, wherein FIG. 9(*a*) is a sectional view and FIG. 9(*b*) is a perspective view.
Figure 9B:
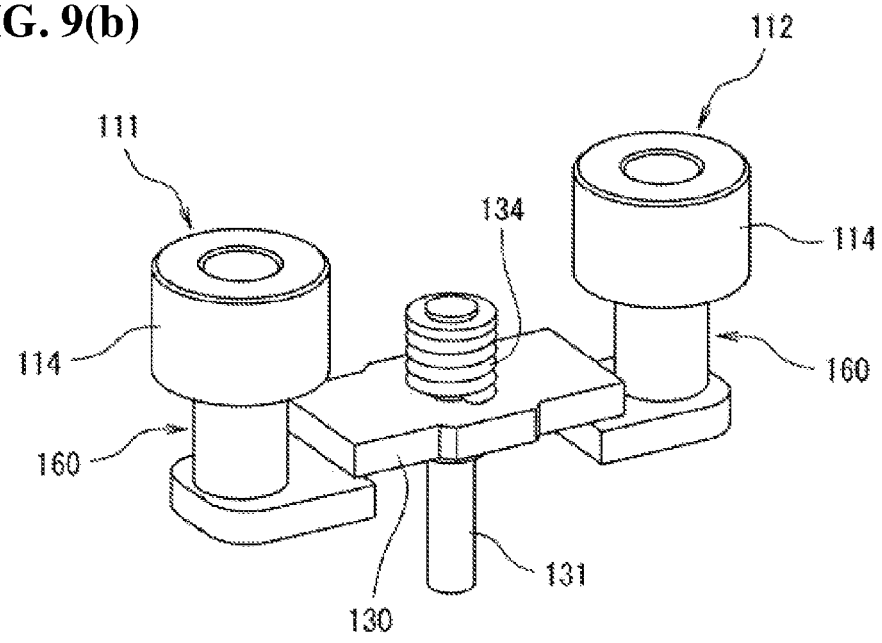

For example, an L-shaped portion 160 in a form such that the upper plate portion 116 of the C-shaped portion 115 is omitted, may be connected to the support conductor portion 114, as shown in FIGS. 9(*a*) and (*b*). In this case too, in the closed contact condition wherein the movable contact 130 contacts the fixed contacts 111 and 112, it is possible to cause magnetic flux generated by the current flowing through a vertical plate portion of the L-shaped portion 160 to act on portions in which the fixed contacts 111 and 112 and the movable contact 130 contact. Therefore, it is possible to increase the magnetic flux density in the portions in which the fixed contacts 111 and 112 and the movable contact 130 contact, generating a Lorentz force that opposes the electromagnetic repulsion force.

Figure 10A:
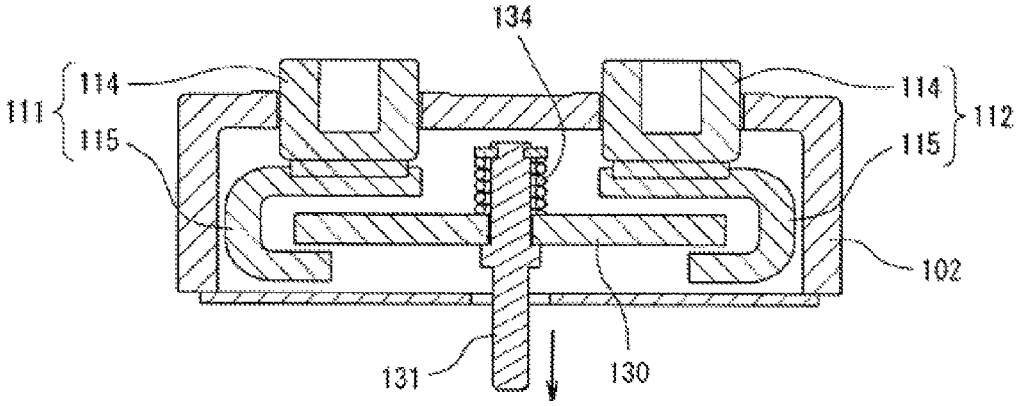
FIGS. 10(*a*) and 10(*b*) are diagrams showing another modification example of a contact device applicable to the invention, wherein FIG. 10(*a*) is a sectional view and FIG. 10 (*b*) is a perspective view.
Figure 10B:
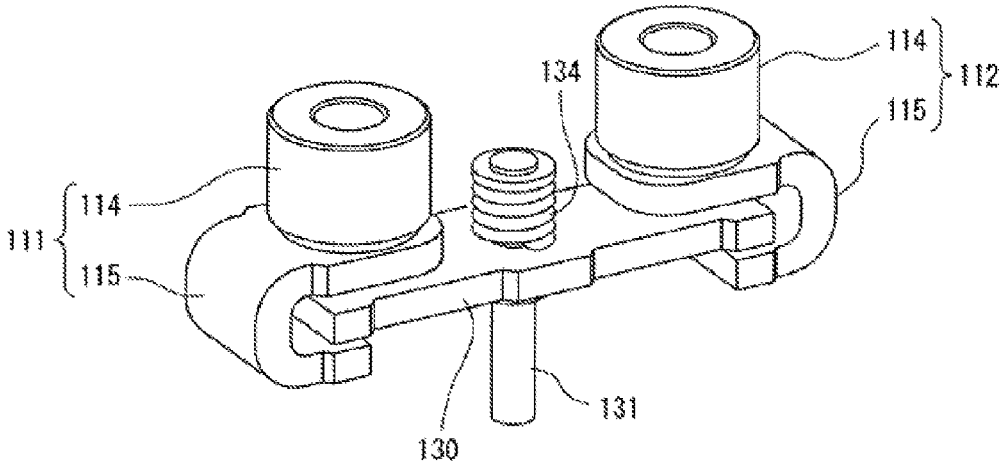

Also, the depressed portion 132 may be omitted, forming a flat plate, as shown in FIGS. 10(*a*) and (*b*).

Also, in the first to fourth embodiments, a description has been given of a case wherein the connecting shaft 131 is screwed to the movable plunger 215, but it is not limited to screwing, and it is possible to apply an arbitrary connection method, and furthermore, the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but this is not limiting. That is, a large diameter portion for positioning may be formed protruding in a radial direction in the C-ring position of the connecting shaft 131, the contact spring 134 disposed after the movable contact 130 contacts with the large diameter portion, and the upper end of the contact spring 134 is fixed with the C-ring.

Also, the electromagnet unit 200 is not limited to the heretofore described configuration either, and an electromagnet unit of any configuration can be applied, provided that the movable contact 130 can be driven so to be connectable to and detachable from the fixed contacts 111 and 112.

Also, in the first to fourth embodiments, a description has been given of a case wherein a hermetic receptacle is formed by the contact housing case 102 and cap 230, and gas is encapsulated inside the hermetic receptacle, but it is not limited to this and the gas encapsulation may be omitted when the interrupted current is small.

REFERENCE SIGNS LIST

10 . . . Electromagnetic contactor, 100 . . . Contact device, 101 . . . Contact mechanism, 102 . . . Contact housing case,

104 . . . Metal tubular body, 105 . . . Fixed contact support insulating substrate, 111, 112 . . . Fixed contact, 114 . . . Support conductor portion, 115 . . . C-shaped portion, 121 . . . Insulating cover, 130 . . . Movable contact, 130*a* . . . Contact portion, 131 . . . Connecting shaft, 134 . . . Contact spring, 140 . . . Insulating cylinder, 141, 142 . . . Magnet housing pocket, 143, 144 . . . Arc extinguishing permanent magnet, 145, 146 . . . Arc extinguishing chamber, 147 . . . Resin molded material, 148 . . . Thermally conductive filler, 149 . . . High thermal conductivity plate, 150 . . . High thermal conductivity cylinder, 151 . . . Arc, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger

What is claimed is:

1. An electromagnetic contactor, comprising:

a contact housing case having an insulating property, a pair of fixed contacts and a movable contact disposed so as to be connectable to and detachable from the pair of fixed contacts, with a predetermined interval therebetween, and disposed inside the contact housing case, and an arc extinguishing chamber formed inside the contact housing case at a position where the movable contact and the pair of fixed contacts contact, wherein at least an inner wall surface of the arc extinguishing chamber contacting an arc is formed of a high thermal conductivity material having thermal conductivity higher than that of a synthetic resin molded material.

2. The electromagnetic contactor according to claim 1, wherein the high thermal conductivity material includes one of alumina ceramic, aluminum nitride, or boron nitride.

3. The electromagnetic contactor according to claim 1, wherein the high thermal conductivity material is a material insert molded in the inner wall surface of the synthetic resin molded material.

4. The electromagnetic contactor according to claim 1, wherein the arc extinguishing chamber is formed of the synthetic resin molded material mixed with a thermally conductive filler.

5. The electromagnetic contactor according to claim 4, wherein the thermally conductive filler includes one of alumina ceramic, aluminum nitride, iron, aluminum, or copper.

6. The electromagnetic contactor according to claim 1, wherein the arc extinguishing chamber includes a metal thermally conductive material having thermal conductivity higher than that of the synthetic resin molded material disposed on the inner surface of the arc extinguishing chamber.

7. The electromagnetic contactor according to claim 6, wherein the metal thermally conductivity material is insert molded in the inner surface of the synthetic resin molded material.

8. The electromagnetic contactor according to claim 6, wherein the metal thermally conductivity material is mounted so as to cover the inner surface of the synthetic resin molded material.

9. The electromagnetic contactor according to claim 6, wherein the metal thermally conductivity material is a material coated onto the inner surface of the synthetic resin molded material.

10. The electromagnetic contactor according to claim 1, wherein the contact housing case includes:

a metal tubular body having an opening at an upper end, a fixed contact support insulating substrate closing the opening of the metal tubular body, and an insulating cylinder disposed on an inner side of the metal tubular body to cover the inner wall surface for increasing thermal transmission, the insulating cylinder having a side portion covering an inner side surface of the arc extinguishing chamber, and a bottom portion facing the fixed contact support insulating substrate to cover a bottom surface of the arc extinguishing chamber, and the side portion of the insulating cylinder, the bottom portion of the insulating cylinder, and the fixed contact support insulating substrate define and directly face the arc extinguishing chamber enclosing the pair of fixed contacts and the movable contact.

11. The electromagnetic contactor according to claim 10, wherein the insulating cylinder is formed from a ceramic with high thermal conductivity material including alumina ceramic, aluminum nitride, or boron nitride.

12. The electromagnetic contactor according to claim 10, wherein the insulating cylinder includes a first high thermal conductivity plate formed in the side portion, and a second high thermal conductivity plate formed in the bottom portion for transferring heat of the arc.

13. The electromagnetic contactor according to claim 12, wherein the first and second high thermal conductivity plates have a thermal conductivity higher than 0.2 W/mK.

* * * * *